US006463689B1

(12) United States Patent
McElroy

(10) Patent No.: US 6,463,689 B1
(45) Date of Patent: Oct. 15, 2002

(54) GUN DISABLING MECHANISM

(76) Inventor: Bill R. McElroy, 2389 Scotland Rd., Chambersburg, PA (US) 17201

( * ) Notice: Subject to any disclaimer, the term of this patent is extended or adjusted under 35 U.S.C. 154(b) by 0 days.

(21) Appl. No.: 09/525,685

(22) Filed: Mar. 15, 2000

Related U.S. Application Data

(60) Provisional application No. 60/147,489, filed on Aug. 9, 1999.

(51) Int. Cl.[7] ..... F41A 17/00

(52) U.S. Cl. ..... 42/70.08; 42/70.11

(58) Field of Search ..... 42/70.11, 70.05, 42/70.08, 70.04

(56) References Cited

U.S. PATENT DOCUMENTS

| | | | | | |
|---|---|---|---|---|---|
| 2,803,910 | A | * | 8/1957 | Lyle | 42/70.11 |
| 2,945,316 | A | | 7/1960 | Mulno | 42/70.08 |
| 3,624,947 | A | * | 12/1971 | Worrall | 42/66 |
| 3,673,725 | A | | 7/1972 | Cravener | 42/70.11 |
| 4,110,928 | A | * | 9/1978 | Smith | 42/66 |
| 4,135,320 | A | * | 1/1979 | Smith | 42/70.11 |
| 4,136,475 | A | | 1/1979 | Centille | 42/70.04 |
| 4,154,014 | A | * | 5/1979 | Smith | 42/70.11 |
| 4,763,431 | A | | 8/1988 | Allan et al. | 42/70.11 |
| 4,926,575 | A | | 5/1990 | Pastor | 42/70.06 |
| 5,016,376 | A | * | 5/1991 | Pugh | 42/70.11 |
| 5,022,175 | A | * | 6/1991 | Oncke et al. | 42/70.11 |
| 5,081,779 | A | | 1/1992 | Pack | 42/70.11 |
| 5,361,525 | A | | 11/1994 | Bowes | 42/70.11 |
| 5,448,847 | A | * | 9/1995 | Teetzel | 42/70.11 |
| 5,519,956 | A | | 5/1996 | Howell | 42/70.08 |
| 5,546,690 | A | | 8/1996 | Ciluffo | 42/70.11 |
| 5,603,179 | A | * | 2/1997 | Adams | 42/70.08 |
| 5,651,206 | A | * | 7/1997 | Matarazzo | 42/70.08 |
| 5,910,003 | A | * | 6/1999 | Kleinpaul | 42/70.11 |

* cited by examiner

*Primary Examiner*—Michael J. Carone
*Assistant Examiner*—Denise J. Buckley
(74) *Attorney, Agent, or Firm*—Nixon & Vanderhye P.C.

(57) ABSTRACT

A gun disabler includes a disabler block engaged with a hammer strut and a rebound slide block. The disabler block selectively engages the hammer strut and the rebound slide block in a locked position such that both the hammer and the rebound slide are prevented from movement. The disabler block is displaceable to an unlocked position that is disengaged with the hammer strut and the rebound slide. A locking mechanism coupled with the disabler block shifts the disabler block between its locked position and its unlocked position. The double locking structure thus prevents the trigger from being pulled and additionally prevents the hammer from being cocked. The locking mechanism is configured such that only authorized users can enable the weapon.

15 Claims, 3 Drawing Sheets

GUN DISABLING MECHANISM

This application claims benefits of provisional application No. 60/147,489 filed Aug. 9, 1999.

BACKGROUND AND SUMMARY OF THE INVENTION

The present invention relates to a gun disabling mechanism and, more particularly, to a gun disabling mechanism that disables both the trigger and hammer of a gun and can be activated only by an authorized user.

Gun misuse has been steadily on the rise in the United States. It has been theorized that such misuse is typically the product of unauthorized acquisition and use of handguns and the like such as by theft. It would thus be desirable to provide a gun disabling mechanism that is tamper-proof such that if tampered with would permanently disable the gun and that can only be deactivated by an authorized user.

In a typical handgun assembly, a trigger is coupled with a rebound slide and a lifting mechanism to a hammer that effects firing of the gun. As the trigger is pulled, the lifting mechanism of the trigger assembly rotates the gun cylinder (in a revolver type gun) and cocks the hammer for firing. After firing, the rebound slide serves to return the trigger and lifting mechanism to a home position for subsequent firing. In some gun models, so-called double-action revolvers, the hammer itself can be cocked and possibly fired without actuating the trigger.

The gun disabling mechanism according to the invention disables both the hammer and the rebound slide, thereby preventing both hammer firing and trigger firing, with a disabler block selectively engaging a hammer strut and a rebound slide block engaged with the hammer and rebound slide, respectively. A locking mechanism is coupled with the disabler block that slides the disabler block between the locked position and the unlocked position. The locking mechanism is preferably configured such that only an authorized user can displace the disabler block from its locked position to its unlocked position.

In accordance with an exemplary embodiment of the invention, a gun disabling mechanism is provided for selectively disabling a gun including a hammer, a hammer strut that drives the hammer via a spring, a trigger, and a rebound slide engageable with the trigger. The gun disabling mechanism includes a rebound slide block selectively engageable with the rebound slide. The housing supports the rebound slide block and the hammer strut. A disabler member is disposed in the housing and is displaceable between a locked position engaging the rebound slide block and the hammer strut and an unlocked position disengaged from the rebound slide block and the hammer strut. The mechanism may also include a key actuator including a disabler member driving part disposed within the housing and a key receiving part disposed outside of the housing. The driving part engages the disabler member for displacing the disabler member between the locked position and the unlocked position, and the receiving part is shaped to receive a key for controlling a position of the disabler member. The receiving part preferably includes a pair of locking holes, wherein the disabling mechanism includes a pair of locking pins disposed in corresponding apertures in the housing. The locking pins are urged into engagement with the locking holes by corresponding springs disposed in the apertures for preventing the key actuator from being displaced. The key for controlling the position of the disabling member includes a pair of prongs corresponding to the pair of locking holes and the pair of locking pins therein such that the prongs deflect the locking pins from the locking holes in the key actuator receiving part, thereby enabling the key actuator to be displayed.

The disabler member driving part of the key actuator preferably includes at least a pair of notches along a circumferential arc segment thereof. The disabling mechanism also includes a bearing disposed within the housing adjacent the key actuator that is urged into engagement with a facing one of the notches. The disabler member preferably includes a ramped surface facing the rebound slide block in the housing such that the ramped surface deflects the rebound slide block when the disabler member is displaced from the unlocked position to the locked position. In preferred forms, the gun disabling mechanism is sized to be integrated into a handle of the gun.

In accordance with another exemplary embodiment of the invention, the gun disabling mechanism for a gun includes a housing supporting at least one component necessary for firing the gun, and a disabler member disposed in the housing and being selectively engageable with the at least one component. In this context, the at least one component may include a hammer strut that drives a hammer via a spring and/or a rebound slide assembly engageable with the trigger, which assembly includes a rebound slide block selectively engageable with a rebound slide.

In accordance with yet another exemplary embodiment of the invention, a method of selectively disabling a gun with a gun disabling mechanism includes the steps of securing at least one component necessary for firing the gun within a housing in the gun, and disposing a disabler member in the housing that is selectively engageable with the at least one component.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

The gun disabler mechanism according to the present invention will be described in accordance with its application to a revolver type gun. The disabler mechanism, however, can be incorporated into alternative gun types such as semi-automatic pistols, rifles, shotguns, and military/assault weapons, and the invention is not meant to be limited to the described application.

Figure 1:
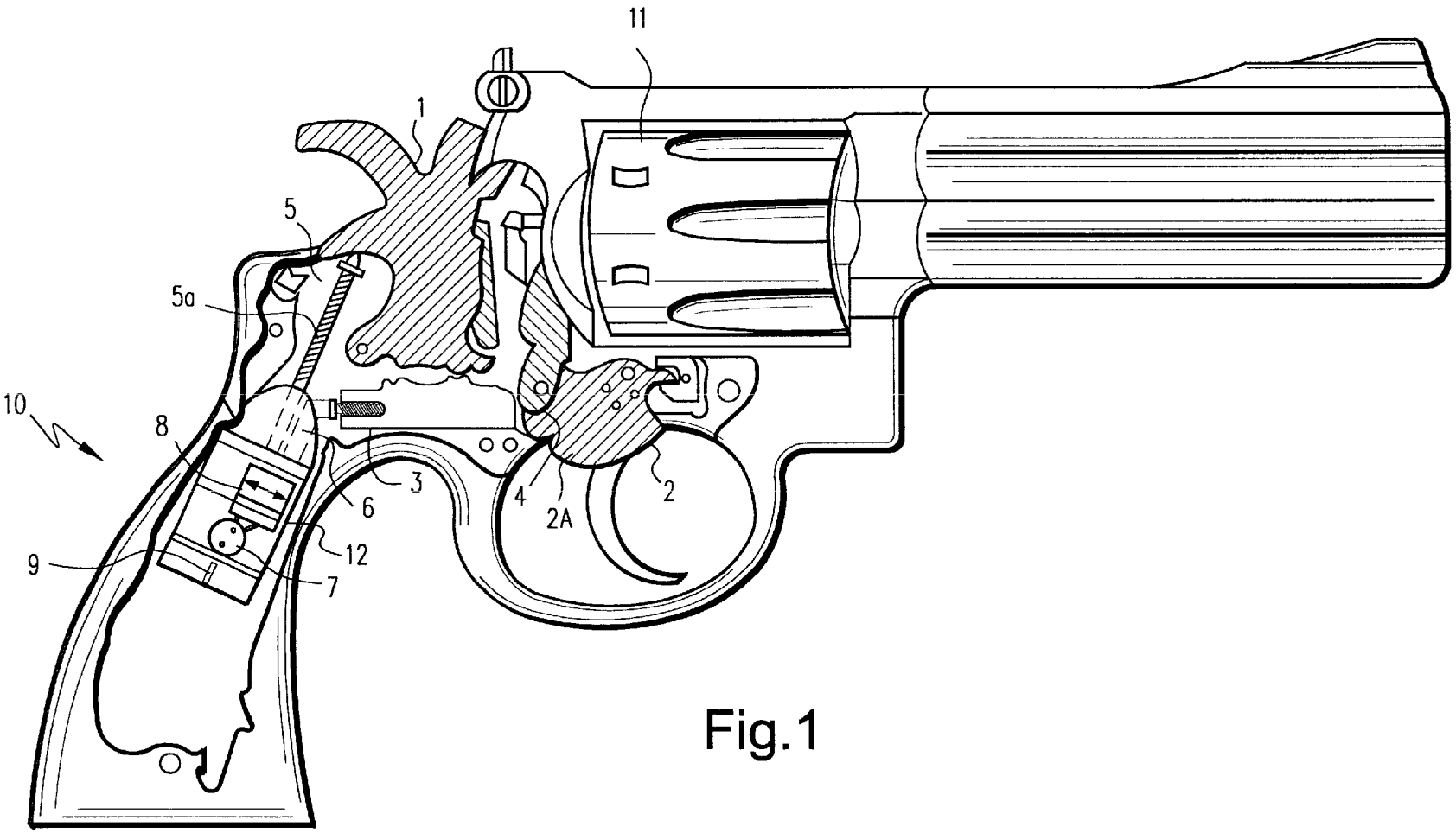
FIG. 1 is a side view of the gun disabling mechanism according to the invention installed in the handle of a revolver type gun in its locked position.

FIG. 1 illustrates the components of a revolver type gun incorporating the disabling mechanism according to the invention. The gun includes a trigger assembly 2 that engages a rebound slide 3, a lifter 4, and the gun hammer 1. In operation, as the trigger is pulled, the trigger assembly 2 displaces the lifter 4 upwardly to rotate the cylinder 11 of the gun, shifts the rebound slide 3 rearwardly, and cocks the hammer 1. As the hammer is cocked, a hammer strut 5 is deflected, and a spring 5A surrounding the hammer strut 5 is compressed. When the weapon is fired, the hammer 1 is released, and the hammer strut 5 drives the hammer 1 toward the cylinder 11 to effect ignition of the ammunition in the cylinder 11. The rebound slide 3 returns the lifter 4 and trigger 2 to a home position for subsequent firing.

Figure 2:
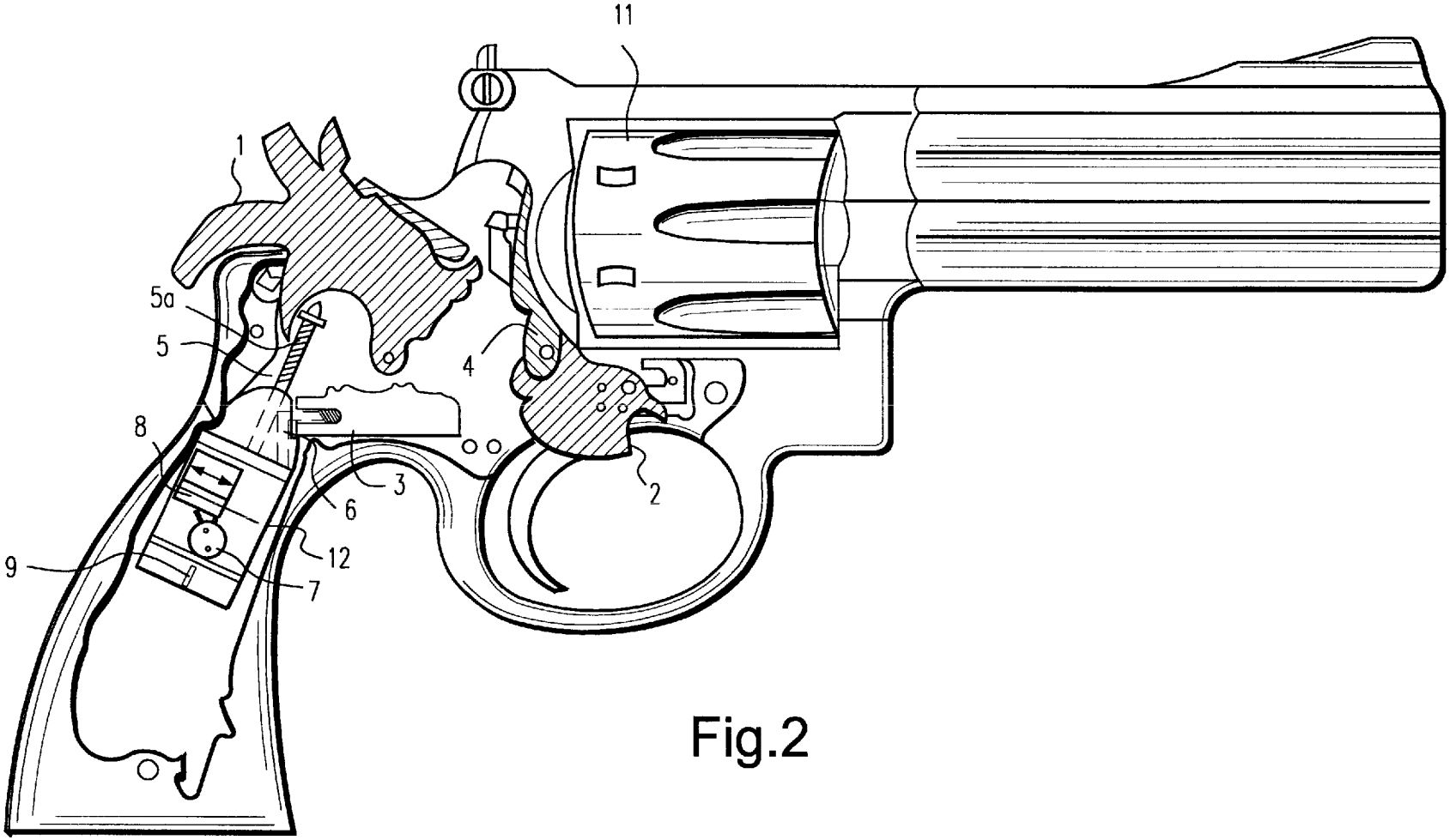
FIG. 2 illustrates the gun disabling mechanism according to the invention in its unlocked position.

The disabling mechanism 10 according to the invention includes a housing 12 that supports the hammer strut 5 and spring 5A and contains a disabler member or block 8 selectively engageable in a locked position with the hammer strut 5. The disabling mechanism also includes a rebound slide block 6 in the housing that is engaged with the rebound slide 3. In the locked position as shown in FIG. 1, the hammer strut 5 and rebound slide 3 are prevented from movement. The disabler block 8 is slidable to an unlocked position as shown in FIG. 2, wherein the disabler block 8 is disengaged with the hammer strut 5 and the rebound slide block 6, thereby enabling the weapon to be fired.

Figure 4:
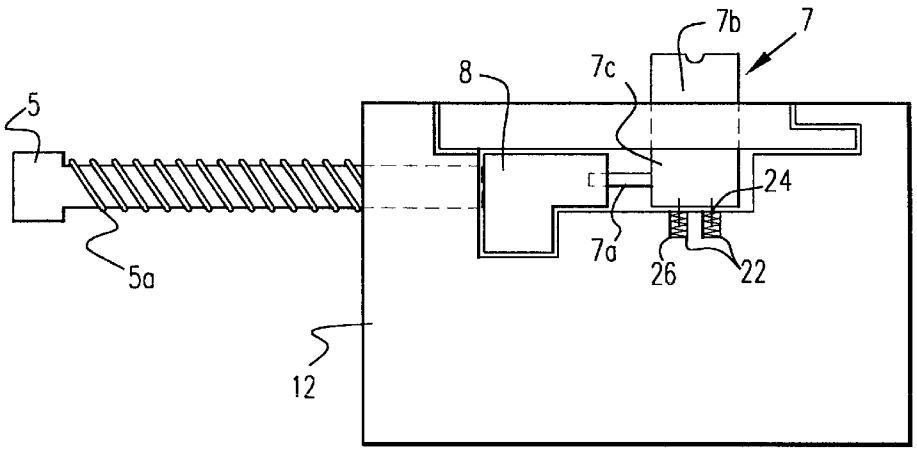
FIG. 4 is a side view of the gun disabling mechanism.
Figure 5:
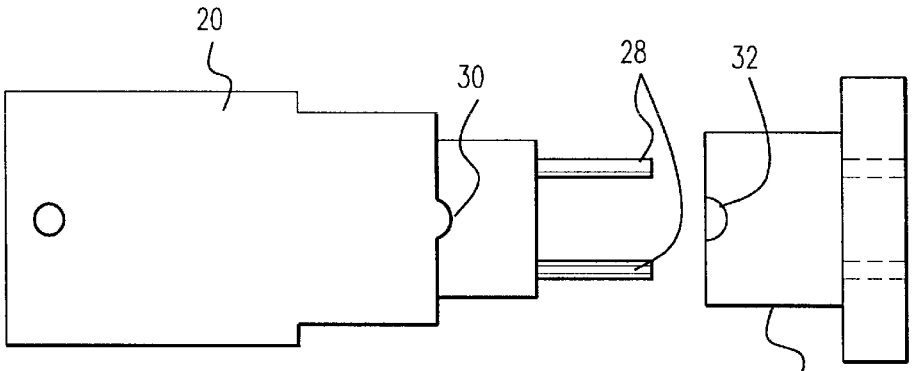
FIG. 5 shows an exemplary key and the key actuator of the gun disabling mechanism.
Figure 3:
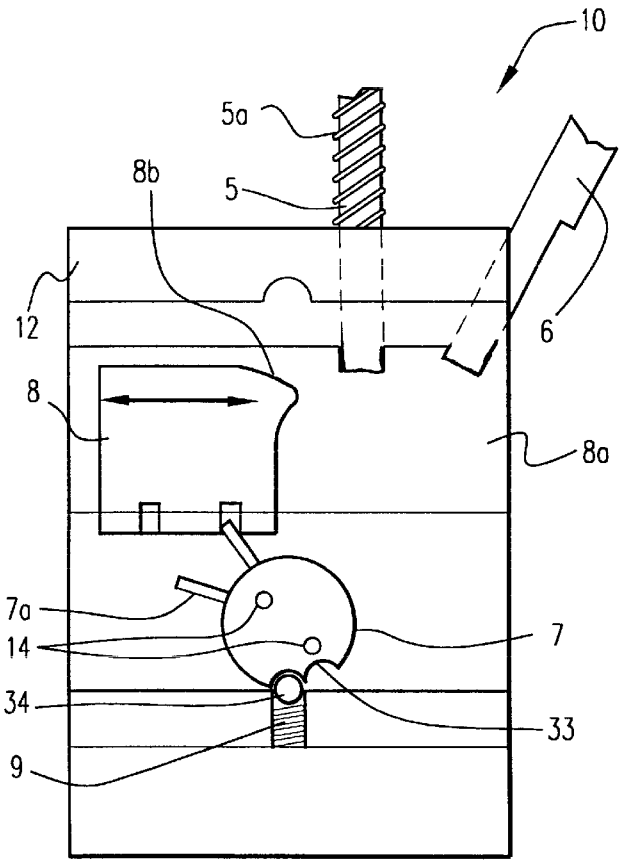
FIG. 3 is a plan view illustrating the components of the gun disabling mechanism.

A more detailed illustration of the locking mechanism is shown in FIGS. 3 and 4. The disabler block 8 in FIG. 3 is shown in the unlocked position, disengaged from the hammer strut 5 and the rebound slide block 6. That is, in the unlocked position, the hammer strut 5 can be deflected into the disabler block area 8*a* by cocking the hammer against the force of the spring 5A, and the rebound slide block 6 is also displaced into the disabler block area 8*a*, enabling the trigger to be pulled. The disabler block 8 is preferably provided with a ramped surface 8*b* at an end thereof facing the rebound slide block 6. The ramped surface 8*b* deflects the rebound slide block 6 when the disabler block 8 is displaced from the unlocked position to the locked position.

A key cylinder 7 drives the disabler block 8 between the unlocked position and the locked position. As shown, the key cylinder or key actuator 7 includes a pair of actuating pins 7*a* that engage corresponding apertures in the disabler block 8. As the key cylinder 7 is rotated, the pins 7*a* drive the disabler block between the unlocked position and the locked position. With particular reference to FIG. 4, the key actuator includes a disabler member driving part 7*c* disposed within the housing 12, including the actuator pin 7*a*, and a key receiving part 7*b* disposed outside of the housing 12. The receiving part 7*b* is shaped to receive a key 20 for controlling the position of the disabler block 8. In this context, the housing also includes one or more apertures 22 that receive locking pins 24, which are urged into engagement with the key cylinder 7 by springs 26. The pins 24 protrude through a pair of apertures 14 in the key cylinder 7. With this configuration, the locking pins prevent the key cylinder 7 from being turned to displace the disabler block 8 from the locked or unlocked position.

The key 20 includes a number of prongs 28 corresponding to the number of locking pins 24 that deflect the locking pins 24 from the locking holes 14 in the key actuator receiving part, thereby enabling the key actuator 7 to be displaced. A protrusion 30 of the key 20 engages a corresponding notch 32 in the key cylinder 7, and the prongs 28 are sized such that when the key 20 is properly inserted in the key receiving part 7*b* of the key cylinder 7, distal ends of the prongs 28 are substantially flush with a bottom surface of the key receiving part 7*b* of the key cylinder 7. As a consequence, the locking pins are cleared from the key cylinder, while the prongs 28 of the key 20 do not extend into the locking holes 22 in the housing, thereby enabling the key cylinder 7 to be turned.

As shown in FIG. 3, the disabler block driving part 7*c* of the key cylinder 7 may also be provided with a pair of notches 33 along a circumferential arc segment thereof. A bearing 34 is urged into engagement with the notches 33 by a spring 9. With this structure, as the key cylinder 7 is rotated between the disabler block 8 locked and unlocked positions, the user has a tactile feel for each position.

With the construction of the gun disabling mechanism according to the invention, the key 20 can be configured to be unique for each mechanism according to known methods, thereby deterring theft. For example, the configurations of the prongs 28, including number, position, size, etc., can be varied from mechanism to mechanism. Each key is preferably provided with a serial number matching a serial number of the gun. Moreover, the likelihood of tampering is considerably reduced by integrating the housing 12 into the firing assembly. That is, the spring 5*a* surrounding the hammer strut 5, which drives the hammer 1 of the gun toward the cylinder 11 to effect ignition of the ammunition, it is supported against the surface of the housing. In this context, if the housing is removed, the weapon could not be fired. Moreover, by integrating the gun disabling mechanism into the handle of the gun, a streamlined appearance is achieved, and the original exterior shape of the gun is maintained.

The gun disabler housing is made of aircraft aluminum and adds no significant weight to the gun. The hammer strut, rebound slide block and disabler block are made of hardened steel. The entire mechanism adds only two to three ounces to the overall weight of the gun.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A gun disabling mechanism for selectively disabling a gun including a hammer, a hammer strut that drives the hammer via a spring, a trigger, and a rebound slide engageable with the trigger, the gun disabling mechanism comprising:

a rebound slide block selectively engageable with the rebound slide;

a housing independently positionable in a gun handle cavity and supporting the rebound slide block and the hammer strut, wherein if the housing is removed, at least one of the rebound slide and the hammer strut would be rendered non-functional; and a disabler member disposed in the housing, the disabler member being displaceable between a locked position engaging the rebound slide block and the hammer strut, and an unlocked position disengaged from the rebound slide block and the hammer strut.

2. A gun disabling mechanism according to claim 1, further comprising a key actuator including a disabler member driving part disposed within the housing and a key receiving part disposed outside of the housing, the driving part engaging the disabler member for displacing the disabler member between the locked position and the unlocked position, and the receiving part being shaped to receive a key for controlling a position of the disabler member.

3. A gun disabling mechanism according to claim 2, wherein the receiving part comprises a pair of locking holes, and wherein the disabling mechanism comprises a pair of locking pins disposed in corresponding apertures in the housing, the locking pins being urged into engagement with the locking holes by corresponding springs disposed in the apertures for preventing the key actuator from being displaced.

4. A gun disabling mechanism according to claim 3, wherein the key for controlling the position of the disabler member comprises a pair of prongs corresponding to the pair of locking holes and the pair of locking pins therein such that the prongs deflect the locking pins from the locking holes in the key actuator receiving part, thereby enabling the key actuator to be displaced.

5. A gun disabling mechanism according to claim 2, wherein the disabler member driving part of the key actuator comprises at least a pair of notches along a circumferential arc segment thereof, and wherein the disabling mechanism further comprises a bearing disposed within the housing adjacent the key actuator and being urged into engagement with a facing one of the notches.

6. A gun disabling mechanism according to claim 1, wherein the disabler member comprises a ramped surface facing the rebound slide block in the housing, the ramped surface deflecting the rebound slide block when the disabler member is displaced from the unlocked position to the locked position.

7. A gun disabling mechanism according to claim 1, wherein the gun disabling mechanism is sized to be integrated into a handle of the gun.

8. A gun disabling mechanism for a gun comprising:

a housing independently positionable in a gun handle cavity and supporting at least one component necessary for firing the gun such that if the housing is removed, the at least one component would be rendered non-functional;

a disabler member disposed in the housing and being selectively directly engageable with the at least one component; and a key actuator including a disabler member driving part disposed within the housing and a key receiving part disposed outside of the housing, the driving part engaging the disabler member for displacing the disabler member between a locked position and an unlocked position, and the receiving part being shaped to receive a key for controlling a position of the disabler member, wherein the receiving part comprises a pair of locking holes, and wherein the disabling mechanism comprises a pair of locking pins disposed in corresponding apertures in the housing, the locking pins being urged into engagement with the locking holes by corresponding springs disposed in the apertures for preventing the key actuator from being displaced.

9. A gun disabling mechanism according to claim 8, wherein the at least one component comprises a hammer strut that drives a hammer via a spring.

10. A gun disabling mechanism according to claim 8, wherein the at least one component comprises a rebound slide assembly engageable with a trigger, the rebound slide assembly comprising a rebound slide block selectively engageable with a rebound slide.

11. A gun disabling mechanism according to claim 10, wherein the disabler member comprises a ramped surface facing the rebound slide block in the housing, the ramped surface deflecting the rebound slide block when the disabler member is displaced from the unlocked position to the locked position.

12. A gun disabling mechanism according to claim 8, wherein the key for controlling the position of the disabler member comprises a pair of prongs corresponding to the pair of locking holes and the pair of locking pins therein such that the prongs deflect the locking pins from the locking holes in the key actuator receiving part, thereby enabling the key actuator to be displaced.

13. A gun disabling mechanism according to claim 8, wherein the disabler member driving part of the key actuator comprises at least a pair of notches along a circumferential arc segment thereof, and wherein the disabling mechanism further comprises a bearing disposed within the housing adjacent the key actuator and being urged into engagement with a facing one of the notches.

14. A gun disabling mechanism according to claim 8, wherein the gun disabling mechanism is sized to be integrated into a handle of the gun.

15. A method of selectively disabling a gun with a gun disabling mechanism, the gun including a hammer, a hammer strut that drives the hammer via a spring, a trigger, and a rebound slide engageable with the trigger, the method comprising:

providing a rebound slide block selectively engageable with the rebound slide;

independently supporting a housing in a gun handle cavity;

supporting the rebound slide block and the hammer strut within the housing, wherein if the housing is removed, at least one of the rebound slide and the hammer strut would be rendered non-functional; and disposing a disabler member in the housing that is displaceable between a locked position engaging the rebound slide block and the hammer strut, and an unlocked position disengaged from the rebound slide block and the hammer strut.

* * * * *